United States Patent [19]

Grossmann et al.

[11] Patent Number: 4,750,567

[45] **Date of Patent: * Jun. 14, 1988**

[54] ROTARY HAMMER DRIVING MECHANISM

[75] Inventors: Horst Grossmann, Hünfelden; Klaus Kalbacher, Rangendingen; Claus Kolesch, Bad Urach; Karl Schekulin, Kirchheim-Teck Jesingen, all of Fed. Rep. of Germany

[73] Assignee: Black & Decker Inc., Newark, Del.

[ * ] Notice: The portion of the term of this patent subsequent to Apr. 14, 2004 has been disclaimed.

[21] Appl. No.: 25,880

[22] Filed: Mar. 16, 1987

Related U.S. Application Data

[63] Continuation of Ser. No. 762,715, Aug. 5, 1985, Pat. No. 4,657,088.

[30] Foreign Application Priority Data

Aug. 8, 1984 [DE] Fed. Rep. of Germany ..... 3429140

[51] Int. Cl.[4] ..... B25D 9/00

[52] U.S. Cl. ..... 173/13; 173/48; 173/109; 173/116; 173/123

[58] Field of Search ..... 173/13, 14, 47, 48, 173/104, 109, 116, 122, 123

[56] References Cited

U.S. PATENT DOCUMENTS

| | | | |
|---|---|---|---|
| 1,841,351 | 1/1932 | Trotter | 173/123 |
| 3,650,336 | 3/1972 | Koehler | 173/116 X |
| 4,236,588 | 12/1980 | Moldan et al. | 173/48 |
| 4,290,492 | 9/1981 | Sides et al. | 173/118 |
| 4,325,436 | 4/1982 | Richter et al. | 173/13 |
| 4,366,869 | 1/1983 | Bereiter | 173/122 X |
| 4,442,906 | 4/1984 | Simpson | 173/116 X |
| 4,446,931 | 5/1984 | Bleicher et al. | 173/116 X |
| 4,456,076 | 6/1984 | Schmid et al. | 173/116 |
| 4,657,088 | 4/1987 | Grossmann et al. | 173/123 X |

FOREIGN PATENT DOCUMENTS

| | | |
|---|---|---|
| 2839906 | 3/1980 | Fed. Rep. of Germany . |
| 3136264 | 3/1983 | Fed. Rep. of Germany . |
| 440515 | 1/1936 | United Kingdom . |
| 2048753 | 12/1980 | United Kingdom . |

*Primary Examiner*—Robert P. Olszewski

*Attorney, Agent, or Firm*—Edward D. Murphy; Harold Weinstein; Edward D. C. Bartlett

[57] ABSTRACT

A rotary hammer has a reciprocating piston of a pneumatic impact mechanism driven from a rotatable drive shaft. A coupling element is fixed on, and a drive element slidably mounted on, the drive shaft. These elements have interengageble tapered coupling surfaces and are biased apart by a spring therebetween. The drive element is disposed forwardly of the coupling element and is slidable rearwardly to drivingly engage the coupling surfaces for transmitting drive to the piston. The relative disposition of the drive and coupling elements causes reaction force on the piston, consequential in use upon generation of percussive blows, to urge the drive element into intensified engagement with the coupling element.

20 Claims, 3 Drawing Sheets

ROTARY HAMMER DRIVING MECHANISM

This is a continuation of application Ser. No. 762,715, filed Aug. 5, 1985, now U.S. Pat. No. 4,657,088.

BACKGROUND OF THE INVENTION

The invention relates to a rotary hammer with a pneumatic impact mechanism which comprises a reciprocating piston driving a beat piece. The impact mechanism is capable of being driven by means of a drive element rotatably mounted on a driven drive shaft. The drive element can be brought into engagement with a coupling element fast on the drive shaft.

In a known rotary hammer of this type (see U.S. Pat. No. 4,456,076) there is fixed or non-rotatably formed on the drive shaft a ring-shaped coupling element having an outer surface shaped as a tapering truncated cone. Also on the drive shaft there is rotatably mounted a drive element which carries in an obliquely set annular groove a rotatable ring with a radially projecting pin. This pin is in engagement with the rear end of a piston arranged in a guide tube in which there is also a beat piece between which and the piston a driving excess pressure is built up in operation, as is known for penumatic impact mechanisms of rotary hammers (see U.S. Pat. No. 4,290,492). In order to drive the impact mechanism of the known rotary hammer, the drive shaft carrying the coupling element is axially displaced against spring pressure at the work-piece by contact pressure of the tool held in the tool-holder of the rotary hammer, so that the truncated-cone-shaped peripheral surface of the coupling element is pressed into coupling engagement with a correspondingly truncated-cone-shaped annular surface of the drive element, and thus the drive element is rotated together with the driven drive shaft.

This known rotary hammer has a relatively complicatedly constructed drive element which consists of several parts and consequently requires expensive assembly. In addition, on account of the use of an axially displaceable drive shaft, there is also a relatively larger construction expense.

SUMMARY OF THE INVENTION

It is the object of the invention to create a rotary hammer with an improved drive for the penumatic impact mechanism.

According to the present invention, there is provided a rotary hammer comprising a pneumatic impact mechanism including a reciprocating piston, a rotatably driven drive shaft for driving the impact mechanism, a coupling element fixed non-rotatably on the drive shaft for rotation therewith, and a drive element rotatably mounted on the drive shaft and optionally engageable with the coupling element by axial displacement relative to the drive shaft. Means, drivingly connecting the drive element to the piston, is provided for reciprocating the piston upon rotation of the drive element, the piston being driven in a forward direction to generate percussive blows and returning in a rearward direction. The drive element and the coupling element have interengageable tapered coupling surfaces. The coupling element is disposed rearward of the drive element with the coupling surface of the coupling element facing in the forward direction and the coupling surface of the drive element facing in the rearward direction. The relative disposition of the drive element and the coupling element cause reaction force on the piston consequential upon generation of the percussive blows to urge the drive element into intensified engagement with the coupling element.

In the preferred embodiment, the means for reciprocating the piston comprises a drive fin on the drive element, this drive fin constiuting a cam which extends between two rollers mounted on the rear end of the piston; the two rollers have axes of rotation perpendicular to the longitudinal axis of the piston.

In a preferred form of the invention the coupling element has its coupling surface tapering from back to front, which surface can be brought into engagement with a correspondingly formed surface of the drive element, and the drive element is provided between the coupling element and a tool-holder.

In a construction of this type the recoil of the tool in operation exerts a force pushing the piston backwards so that the roller fixed at the rear end of the piston and adjacent to the front of the drive fin presses against the drive fin and thereby exerts on the drive element a force which enhances the coupling between the latter and the coupling element.

In order to achieve a reliable separtion of the coupling element from the drive element and hence a reliable disconnection of the impact mechanism, there may be provided between the coupling element and the drive element a pressure spring which, on termination of a force pressing the drive element into engagement with the coupling element, effects a reliable separation of the drive element from the coupling element.

Since the impact mechanism works only when the tool is engaged with the work-piece but is at other times disconnected, loads on the impact mechanism and its drive occur only for short periods, so that its life is considerably increased.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
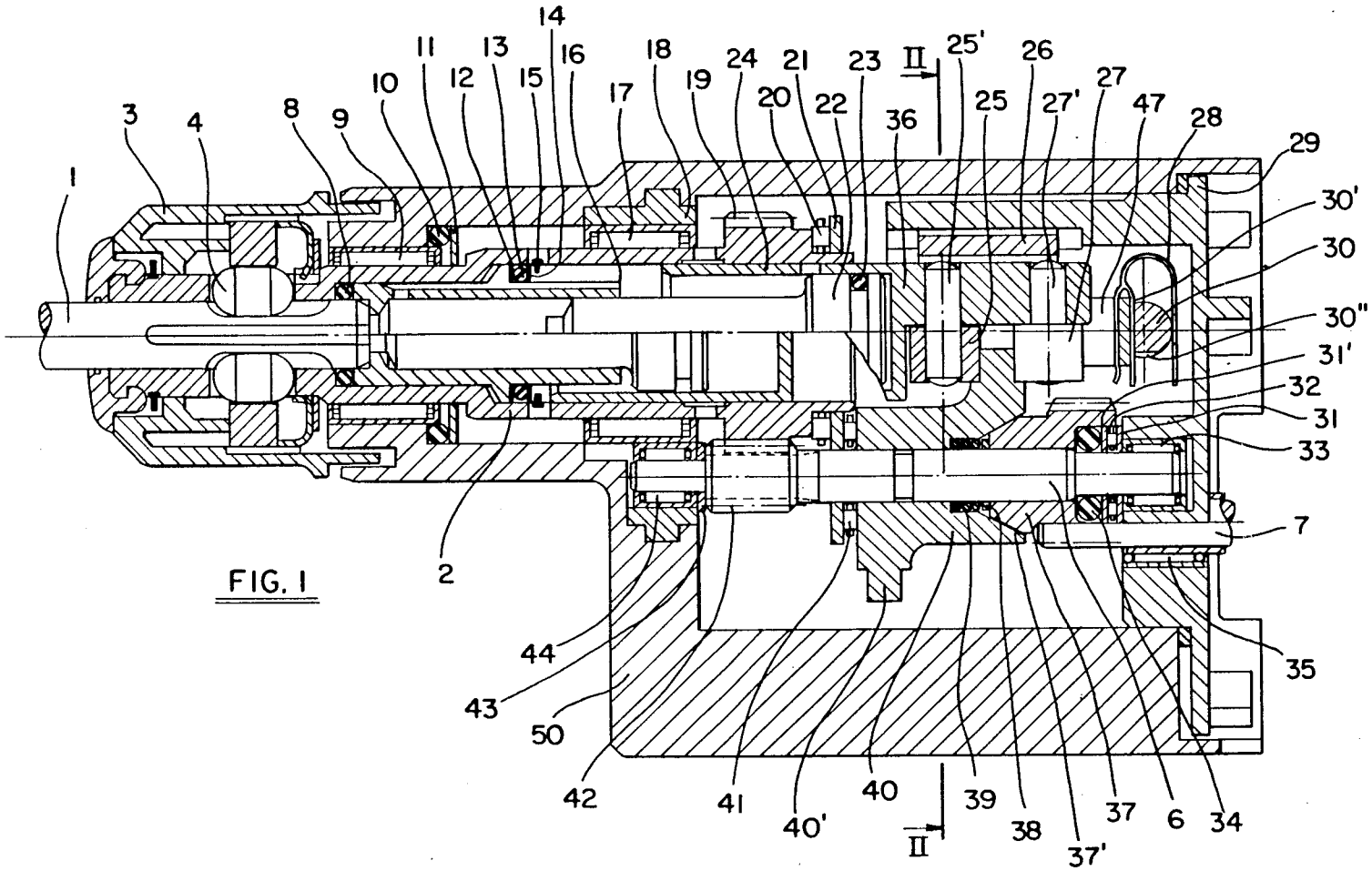
FIG. 1 shows in section a gear housing of a rotary hammer according to the invention together with a tool holder thereof.
Figure 3:
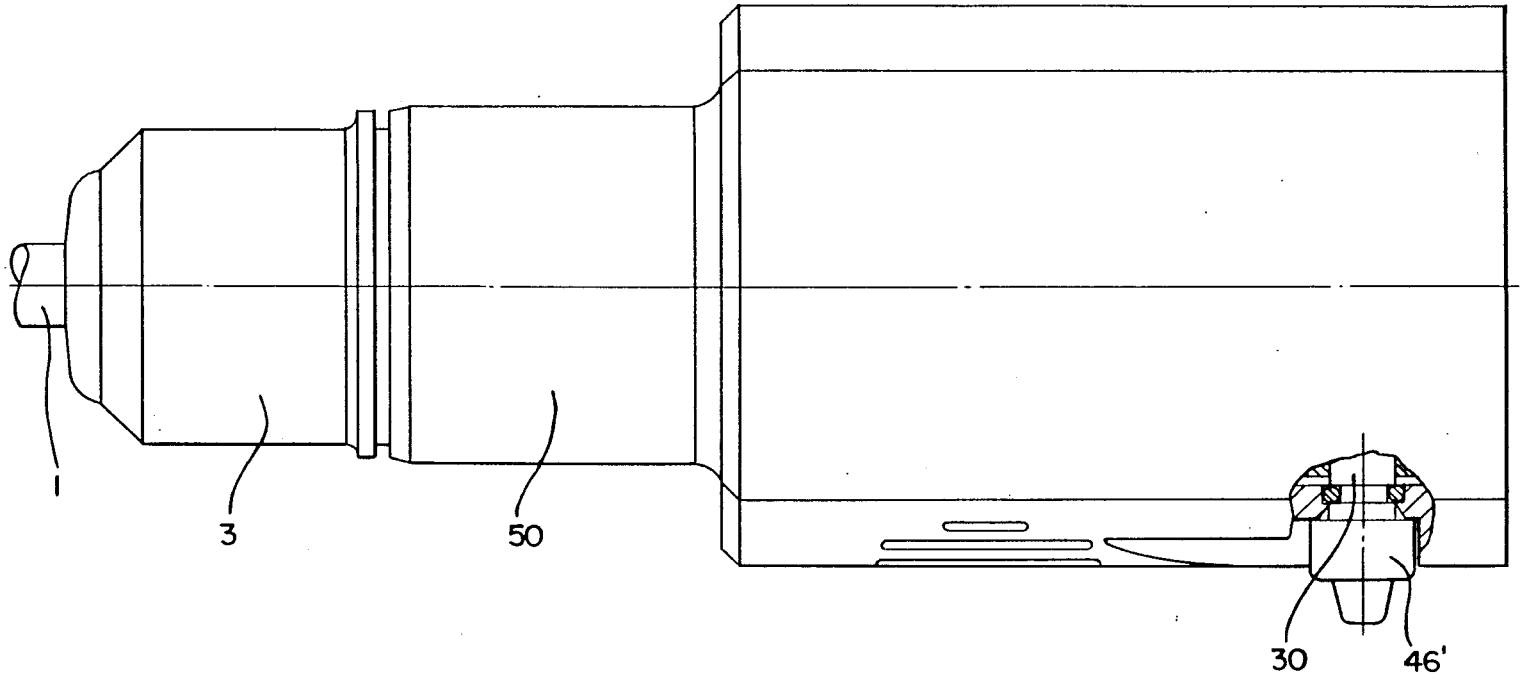
FIG. 3 shows an elevational view of the tool holder and the gear housing in which the gear housing is partially cut away in order to show an actuating lever for a pivot pin.

The illustrated gear housing 50 is connected at its rear end, at the right in FIGS. 1 and 3, to a motor housing, not illustrated, from which the armature-shaft spindle 7 of an electric motor extends into the gear housing 50. The armature-shaft spindle 7 is located with its front portion in a needle bearing 35 which is supported in a metal holder-member 29 inset into the gear housing 50 made of for example synthetic material. In this holder-member 29 there is also supported by means of a needle bearing 33 the rear end of a drive shaft 6 whose front end is held in a needle bearing 44 in the gear housing 50 or a metal inset element fixed in this gear housing 50. On the drive shaft 6 there is fixed, non-rotatably and axially non-displaceably, a coupling element 37 which has an external gear-tooth system which meshes with a pinion formed on the armature-shaft spindle 7.

In an annular recess open towards the rear in the coupling element 37 there is located a resilient damping ring 34 which has its front side resting against the base surface of the recess and its rear side resting against a disk 31'. Between this disk and a further disk 31' resting against an annular surface of the holder-member 29, there is located an axial-spherical or needle bearing 32 which, on rotation of the coupling element 37 and thus of the damping ring 34 and the disk 31', prevents rubbing at the disk 31 which is maintained stationary. The damping ring 34 serves to cushion axial impacts which may be transmitted to the drive shaft 6 in operation.

On the drive shaft 6 there is also rotatably arranged a drive element 40 whose construction and functioning are explained below.

At the front end region of the drive shaft 6 there is formed a toothed gear system 42 which is in meshing engagement with an external toothed gear system 19 of the tool spindle 2 which is held rotatably in bearings 9 and 17. The tool front region of the tool spindle 2 forms a tool holder comprising a casing 3. The tool 1 has the usual axially running grooves in its shank which engage with retaining elements 4. The construction of tool holders of this type for rotatary hammers is known and therefore requires no detailed explanation.

Inside the tool spindle there is located a guide sleeve 16 in which the front end region of a beat piece 22 is guided axially and reciprocally so that, through an opening provided in the front end of the guide sleeve 16, its front end surface can impact on the rear end of the tool 1. Between the front end of the guide sleeve 16 and an annular shoulder of the tool spindle 2, there is arranged a resilient damping ring 8, and between an annular shoulder of the gear housing 50 and an annular shoulder of the tool spindle 2 there are located a resilient damping ring 10 and a disk 11. These damping rings serve for cushioning impacts during idling, while a resilient damping ring 13, which is provided between a disk 12 resting against an annular shoulder of guide sleeve 16 and a disk 14 whose displacement motion is limited by pins 15, effects the damping of backwards directed blows during operational impacting.

The beat piece 22 is guided with its larger-diameter rear end in a tubular piston 24 which is reciprocally movable axially in the tool spindle 2, an O-ring 23 inset in an annular groove of the beat piece 22 providing a seal at the inner surface of the tool spindle 2. In the prolonged rear end 36 of the tubular piston 24 there are fixed perpendicular to the longitudinal axis of the tubular piston two bearing-pins 25' and 27' which carry at their lower ends rotatable rollers 25, 27 repectively. The rear end 36 is disposed in a U-shaped guide 26 which is fixed in the holder-member 29 (FIG. 2), so that the rear end 36 is movable reciprocally in the guide 26 in the direction of the longitudinal axis of the tubular piston 24.

Between the rollers 25 and 27 there extends a drive fin 40' forming a guide cam, which is part of the drive element 40 previously referred to. This drive element is formed in one piece and may for example be a sintered part. The width of the drive fin 40' corresponds essentially with the clear distance between the rollers 25 and 27, so that the external surfaces of these rollers are in engagement with the lateral surfaces of the drive fin 40'.

Between the drive element 40, which is arranged rotatably and axially displaceable on the drive shaft 6, and the front end surface of the coupling element 37 there is arranged a pressure spring 39 surrounding the drive shaft 6, a disk 38 being provided between the rear end of the pressure spring 39 and the front end surface of the coupling element 37. From the external periphery of the front end surface of the coupling element 37 there extends a coupling surface 37' which widens towards the rear in the shape of a truncated cone. The drive element 40 has a correspondingly inclined engagement surface, shown in FIG. 1 in engagement with the coupling surface 37'.

When the rotary hammer is in the resting state the pressure spring 39 biases the drive element 40 and the drive shaft 6 in FIG. 1 towards the left, i.e. towards the front, so that the coupling surface 37' is not in engagement with the correspondingly shaped engagement surface of the drive element 40. In consequence of this displacement of the drive element 40 the separating disk 21, which has an opening surrounding the tool spindle 2 and an opening surrounding the drive shaft 6, is also displaced forwards, whereby the axial-spherical or needle bearing 20 provided between separating disk 21 and an annular shoulder of the tool spindle 2, and hence also the tool spindle 2, are displaced towards the left in FIG. 1, i.e. towards the front in the rotary hammer.

If in this operational setting the rotary hammer is switched on, then the rotating armature-shaft spindle 7 rotates the coupling element 37 via the toothed gear associated therewith, and thus also the drive shaft 6 which, via the meshing toothed gear systems 42 and 19, rotates the tool spindle 2 and thus also the tool 1. When the rotating tool 1 is brought into engagement with a work-piece the contact pressure effects, via the retaining elements 4, an axial displacement of the tool spindle 2 towards the rear, so that the bearing 20, the separating disk 21 and the axial-spherical or needle bearing 41 between the separating disk 21 and the drive element 40 are likewise displaced towards the rear, which leads to a shift of the drive element 40 in the direction of the coupling element 37 and thus to the engagement of coupling surface 37' and associated engagement surface of the drive element 40. By this means the drive element 40, together with the coupling element 37 rigidly fixed to the drive shaft 6, are rotated and the drive fin 40', which follows essentially the path of an obliquely-set circle, is guided between the rollers 25 and 27. This results in an axial reciprocating motion of the tubular piston 24 carrying the rollers 25 and 27 so that, due to build-up of excess pressure and resulting under-pressure, the beat piece 22 located in the tubular piston is displaced reciprocally in combination with the motion of the tubular piston 24 in the manner described in U.S. Pat. No. 4,290,492, so as to impact on the rear end of the tool. Meanwhile the resulting recoil blows press the tubular piston 24 backwards and thereby intensify the pressure of the roller 25 on the drive fin 40' and thus also the engagement of the drive element 40 and the coupling element 37.

As soon as the tool 1 is no longer pressed against the work-piece, the spring 39 effects a separation of the coupling element 37 from the drive element 40 and thereby a stopping of the impact drive, so that the tubular piston 24 is no longer reciprocally displaced and hence the beat piece 22 no longer applies impacts to the rear end of the tool 1. In this connecton it may be mentioned that in consequence of the absence of driving of the impact mechanism in this idling state of operation, no special interception device is required for the beat piece 22.

Figure 2:
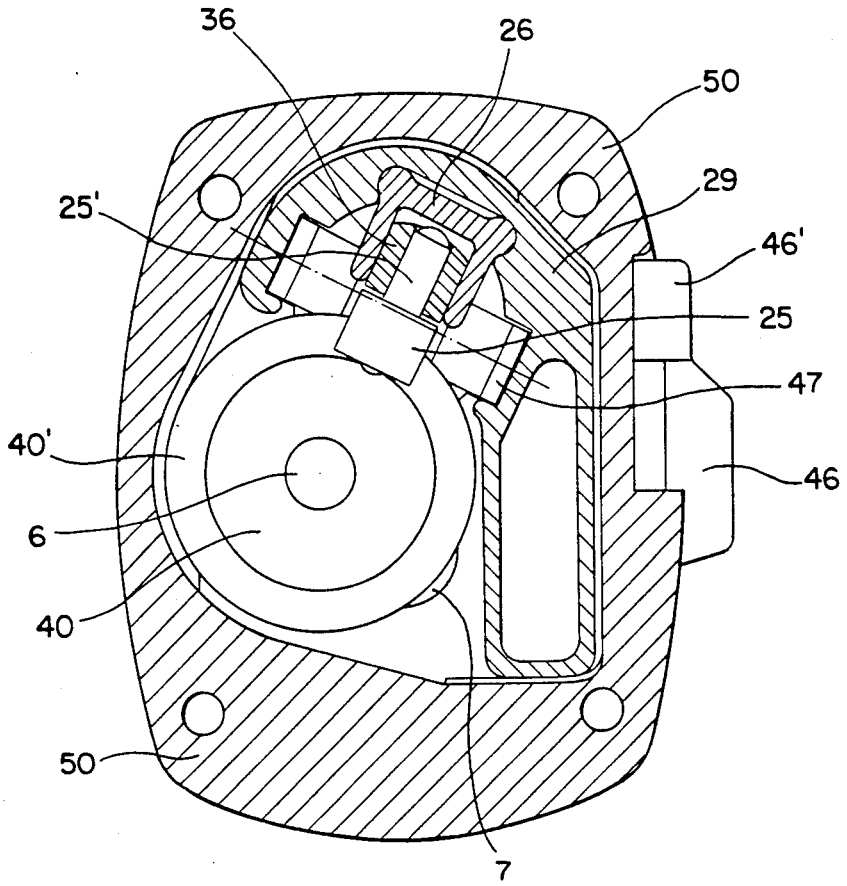
FIG. 2 shows a section on the line II—II of FIG. 1.

In order to activate or de-activate the impact mechanism at choice there is provided a U-shaped rigid setting element 47 whose limbs pass to either side of the rear end 36 of the tubular piston 24 and are led in recesses in the holder member 29 (FIG. 2). The base of this U-shaped setting element 47 rests against a rounded-off zone 30' (FIG. 1) of the peripheral surface of a setting pin 30 which is supported in the gear housing 50 so as to be rotatable to a limited extend and which extends transversely to the longitudinal axis of the tubular piston. The setting pin 30 has one end projecting from the gear housing 50 and carries at this end a hand lever 46 which is firmly connected by its head 46' with the projecting end of the setting pin 30.

As illustrated in FIG. 1, the base of the setting element 47 is embraced by one limb of a spring 28 whose other limb rests against the opposite-lying side of the setting pin 30 and which pulls the base of the setting element 47 towards the setting pin 30. In this way the base of the setting element 47 is always held in engagement with the actual rounded off zone at the periphery of the setting pin 30.

At the periphery of the setting pin 30 there are provided two rounded-off zones 30' and 30'', with the rounded-off zone 30' being at a shorter distance from the mid-axis of the setting pin 30 than the rounded-off zone 30''. Hence when the base of the setting element is rested against the rounded-off zone 30' the free ends of the limbs of the setting element 47 are located further to the right in FIG. 1, i.e. further to the rear in gear housing 50, than when the base of the setting element 47 rests against the rounded-off zone 30''. The operational case illustrated in FIG. 1, of the base of the setting element 47 resting against the rounded-off zone 30', is that in which the impact mechanism is activated, i.e. the impact mechanism is switched on by pressure of the tool 1 on the work-piece.

When the hand lever 46 is twisted by 90° (clockwise in FIG. 1), the base of the setting element 47 comes into engagement with the rounded off zone 30'', and in consequence of the greater distance of the rounded-off zone 30'' from the mid-axis of the setting pin 30 it becomes displaced towards the left in FIG. 1, i.e. towards the front in the gear housing. This displacement has the result that the free ends of the limbs of the setting element 47 come into engagement with the separating disk 21 and displace it to a frontal end setting, whereby the tool spindle 2 is also brought into this frontal end setting and is held therein. In this frontal end setting the coupling element 37 and the drive element 40 are not in engagement with one another. If now the tool 1 is pressed against a work-piece, then the engagement of the free ends of the limbs of the setting element 47 (resting against the rounded-off zone 30'') with the separating disk 21 prevents displacement of the tool spindle 2 to the rear and hence engagement of drive element 40 and coupling element 37, i.e. the rotary hammer is operating with a pure drilling action and the impact mechanism is de-activated.

The above described embodiments, of course, are not to be construed as limiting the breadth of the present invention. Modifications, and other alternative constructions, will be apparent which are within the spirit and scope of the invention as defined in the appended claims.

What is claimed is:

1. A rotary hammer, comprising:

a housing;

a tool spindle rotatably mounted in said housing and having a tool holder at a forward end thereof;

a piston reciprocally mounted in said housing for imparting percussion blows via a pneumatic arrangement to a tool bit, when present in use, supported for rotation by said tool holder;

a drive shaft rotatably mounted in said housing in spaced relation to said spindle;

a rotatable coupling element mounted on said drive shaft;

a drive element slidably mounted on said drive shaft for displacement therealong;

said coupling element and said drive element having interengageable tapered engagement surfaces;

said drive element being disposed on said drive shaft forwardly of said coupling element, rearward movement of said drive element along said drive shaft in a direction away from said tool holder effecting driving engagement of said tapered engagement surfaces;

means for moving said drive element forwardly along said drive shaft away from said coupling element to disengage said engagement surfaces;

means for drivingly rotating said coupling element; and means, mounted partly on said drive element and partly on said piston, for drivingly reciprocating said piston upon driven rotation of said drive element by said coupling element, and for intensifying engagement of said engagement surfaces of the drive element and the coupling element by transmitting to said drive element rearward reaction force exerted on the piston during said imparting of said percussion blows.

2. The rotary hammer of claim 1, wherein said drivingly rotating means comprises a pinion on an armature shaft meshing with a gear formed on said coupling element.

3. The rotary hammer of claim 1, wherein said coupling element has a rearwardly open recess containing a resilient damping ring, a forward side of said ring contacting a base surface of said recess and a rear side of said ring contacting a disc supported via a bearing against rearward axial displacement, said damping ring cushioning any axial impacts transmitted in operation to said drive shaft.

4. The rotary hammer of claim 1, wherein said moving means comprises a pressure spring surrounding said drive shaft and operative between said drive element and said coupling element to bias said drive element forwardly.

5. The rotary hammer of claim 1, wherein said means for drivingly reciprocating said piston includes forwardly and rearwardly facing lateral surfaces on said drive element, said lateral surfaces following essentially a path of a circle set obliquely to said drive shaft.

6. The rotary hammer of claim 5, wherein said lateral surfaces define therebetwee a drive fin extending around said drive element.

7. The rotary hammer of claim 1, wherein said tapered engagement surfaces comprises truncated cones.

8. The rotary hammer of claim 7, wherein the engagement surface of said drive element is an internal surface of a rearwardly opening recess at a rear end of said drive element, and the engagement surface of said coupling element is an external surface of a forward end of said coupling element, both said engagement surfaces tapering inwardly towards said drive shaft in a forward direction.

9. A rotary hammer, comprising:

a pneumatic impact mechanism having a beat piece driven by a reciprocating piston;

a rotatably driven drive shaft for driving said impact mechanism;

a coupling element fixed non-rotatably on said drive shaft for rotation therewith;

a drive element rotatably mounted on said drive shaft and optionally engageable with said coupling element by axial displacement relative to said drive shaft;

means, drivingly connecting said drive element to said piston, for reciprocating said piston upon rotation of said drive element, said piston being driven in a forward direction to generate percussive blows and returning in a rearward direction;

said drive element and said coupling element having interengageable tapered coupling surfaces; and said coupling element being rearward of said drive element with the coupling surface of said coupling element facing in said forward direction and the coupling surface of said drive element facing in said rearward direction, the relative disposition of said drive element and said coupling element causing reaction force on said piston consequential upon generation of said percussive blows to urge said drive element into intensified engagement with said coupling element.

10. The rotary hammer of claim 9, wherein said coupling surfaces comprises truncated cones.

11. The rotary hammer of claim 10, wherein said coupling surfaces taper inwardly towards said drive shaft in said forward direction.

12. The rotary hammer of claim 10, further comprising an armature shaft having at one end a pinion which drivingly meshes with a gear formed around said coupling element for driving said drive shaft.

13. The rotary hammer of claim 12, further comprising a spring surrounding said drive shaft and reactive between said coupling element and said drive element and biasing said drive element in said forward direction away from said coupling element.

14. The rotary hammer of claim 13, wherein said means for reciprocating said piston includes forwardly and rearwardly facing surfaces on said drive element extending transversely and obliquely to said drive shaft.

15. The rotary hammer of claim 14, wherein said coupling element is disposed adjacent a rear end of said drive shaft, at a forward end of said drive shaft forwardly of said drive element is provided an intermediate gear which drivingly meshes with a final gear mounted around a hollow spindle for rotation of said spindle, said piston reciprocating inside said spindle, and said spindle having at a forward end a tool holder.

16. A rotary hammer, comprising:

a rotatable tool spindle for holding a tool for operating upon a workpiece, said tool spindle being rearwardly displaceable along an axis about which it is rotatable when, in use, the tool is pressed in a forward direction against the workpiece;

a drive shaft disposed parallel to said axis and geared to said tool spindle for rotatably driving the latter;

an armature shaft geared to said drive shaft for rotatably driving the drive shaft;

a coupling element rigidly secured on a rear end of said drive shaft and having a conical engagement surface facing forwardly at a forward end of said coupling element;

a drive element mounted on said drive shaft and being rotatably and axially displaceable relative thereto;

said drive element being disposed on said drive shaft forwardly of said coupling element, and said drive element having a conical engagement surface facing rearwardly at a rearward end of said drive element;

a spring mounted on said drive shaft between said drive element and said coupling element and biasing said drive element forwardly away from said coupling element to space said engagement surfaces apart;

rearward displacement of said drive element along said drive shaft towards said coupling element effecting driving engagement of said conical engagement surfaces;

a pneumatic impact mechanism for imparting percussive blows to said tool, and including a piston mounted for reciprocation along said axis for generating said percussive blows;

means for drivingly connecting said drive element to said piston and for causing rotation of said drive element to effect said reciprocation of said piston; and said drivingly connecting means also functioning to transmit recoil force on said piston, consequential upon said piston generating said percussive blows, to said drive element as a rearward force enhancing driving engagement of said engagement surfaces.

17. The rotary hammer of claim 16, wherein a pinion on said armature shaft drivingly meshes with a gear formed around said coupling element.

18. The rotary hammer of claim 17, wherein said conical engagement surfaces taper inwardly towards said drive shaft in said forward direction.

19. The rotary hammer of claim 16, wherein said drivingly connecting means includes forwardly and rearwardly facing surfaces associated with said drive element, said forwardly and rearwardly facing surfaces surrounding said drive shaft and being disposed obliquely thereto.

20. The rotary hammer of claim 19, wherein said drivingly connecting means includes means for converting rotary movement of said obliquely disposed forwardly and rearwardly facing surfaces into reciprocating movement of said piston, forward percussive blow generating movement of said piston being provided by said forwardly facing obliquely disposed surface and said recoil force being transmitted to said drive element via said rearwardly facing surface.

* * * * *